United States Patent [19]

Hosking et al.

[11] Patent Number: 4,560,155

[45] Date of Patent: Dec. 24, 1985

[54] SHEET FEEDING APPARATUS WITH SHEET SEPARATOR

[75] Inventors: Steven M. Hosking, Hants; Christopher J. Dixon, Rowlands Castle, both of England

[73] Assignee: De La Rue Systems Limited, Portsmouth, England

[21] Appl. No.: 557,546

[22] Filed: Dec. 2, 1983

[30] Foreign Application Priority Data

Dec. 2, 1982 [GB] United Kingdom ..... 8234422

[51] Int. Cl.[4] ..... B65H 3/56; B65H 3/08; B65H 5/06

[52] U.S. Cl. ..... 271/11; 271/104; 271/107; 271/149; 271/162; 271/169

[58] Field of Search ..... 271/11, 12, 13, 90, 271/99, 100, 101, 102, 104, 107, 108, 149, 162, 164, 167, 169

[56] References Cited

U.S. PATENT DOCUMENTS

| | | | |
|---|---|---|---|
| 3,403,903 | 10/1968 | Crail | 271/104 |
| 3,893,664 | 7/1975 | Thomsen | 271/104 |
| 4,189,139 | 2/1980 | Uchida et al. | 271/162 |
| 4,437,657 | 3/1984 | Selak | 271/104 |

FOREIGN PATENT DOCUMENTS

| | | |
|---|---|---|
| 29779 | 7/1964 | Fed. Rep. of Germany . |
| 1244280 | 8/1971 | United Kingdom . |
| 1296770 | 11/1972 | United Kingdom . |
| 2085411 | 4/1982 | United Kingdom . |

*Primary Examiner*—Bruce H. Stoner, Jr.
*Assistant Examiner*—James E. Barlow
*Attorney, Agent, or Firm*—Cushman, Darby & Cushman

[57] ABSTRACT

This invention relates to sheet feeding apparatus including a cassette for holding a stack of sheets. It is known to provide in the cassette a lip or spring extending into the space in front of the stack, so that when a suction feeder acts on the front sheet to swing it through an arc and introduces it leading end into the nip of a pair of rollers, the leading end is momentarily retarded by the lip of spring. This has the effect of reducing the number of double feeds. In the present invention, the degree to which the lip or spring extends into the space in front of the stack of sheets is adjusted as the cassette is inserted into the apparatus by a control device which is set in accordance with the required rate of feed of the sheets.

4 Claims, 4 Drawing Figures

Fig. 1.
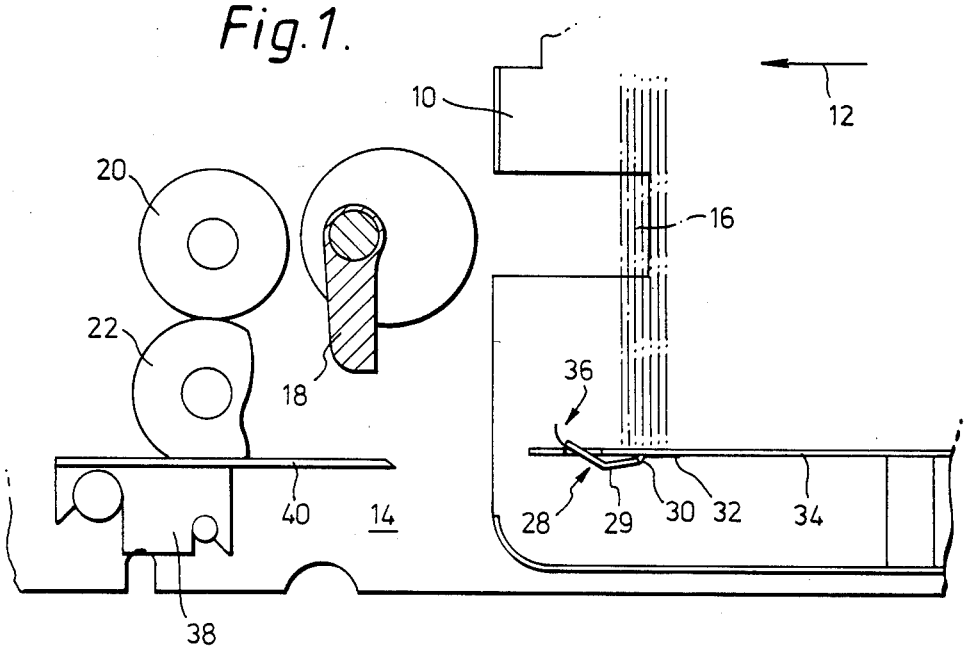
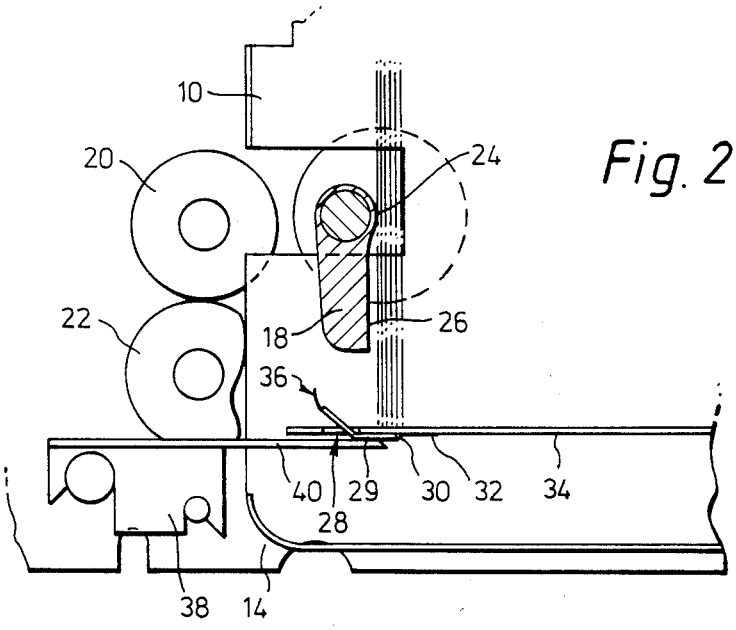
Fig. 2.

Fig. 3.
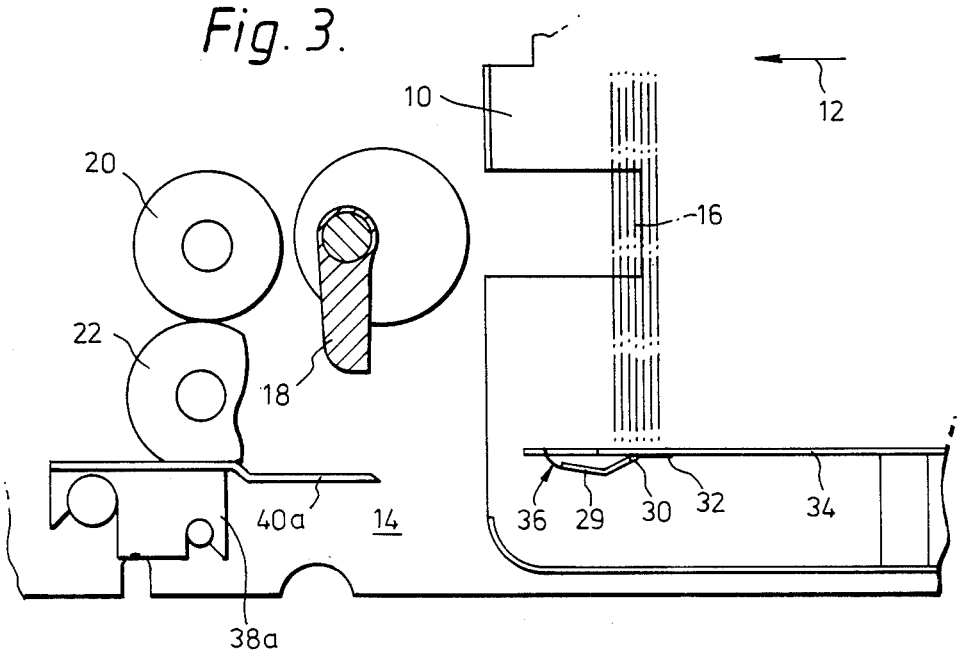
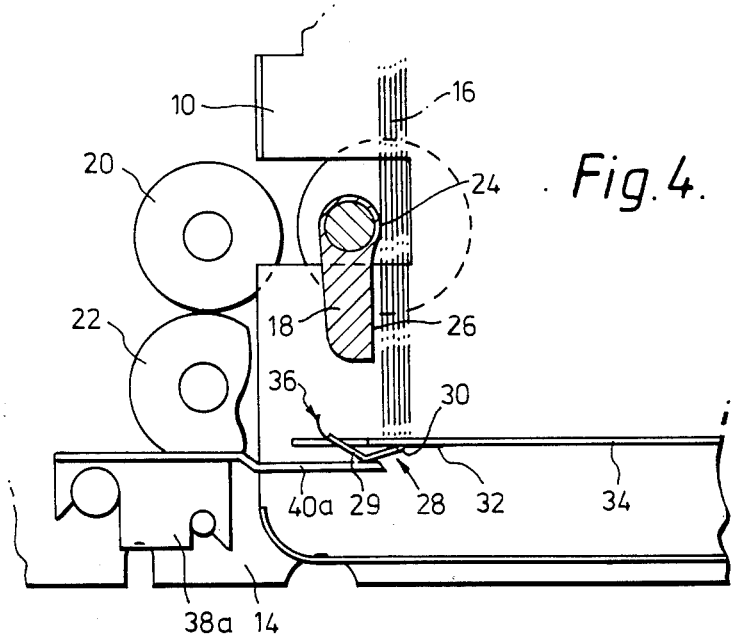
Fig. 4.

SHEET FEEDING APPARATUS WITH SHEET SEPARATOR

BACKGROUND OF THE INVENTION

This invention relates to apparatus for feeding sheets and in particular to the prevention of double feeding. It is particularly advantageous for feeding banknotes.

In one known method of feeding sheets, a suction pick-up device pivots to lift a front sheet from a stack of sheets to be fed. When the sheets (for example banknotes) are in poor condition, it is more difficult for the suction pick-up to feed them singly. For this reason, in sheet-feeding machines of this kind, we have for many years incorporated a separating spring or plate which is normally attached to the stack holder and which is bent so that its end extends into the path of the leading end of the sheet. When the leading end of the sheet encounters the end of the spring or plate, it is momentarily retained by the spring or plate; the suction pick-up continues to move and the sheet therefore assumes a bowed condition. This continues until the end of the note clears the end of the spring or blade. At this point, the leading edge of the sheet is "flicked", i.e. it is subjected to a sudden movement as it rides over the end of the spring or plate.

Such an arrangement greatly reduces the number of double feeds and we have found that the double feeds which still occur vary with the rate of sheet feeding.

Sheet feeding apparatus according to the present invention, comprises: a housing; a cassette for a stack of sheets, movable into and out of the housing to and from a sheet feeding position; and a sheet feeder mounted in the housing and including means for lifting sheets one by one from the stack in the cassette and for advancing each sheet in turn away from the stack; the cassette including an adjustable separator the tip of which, when the cassette is in the sheet-feeding position, extends into the path of an edge of a sheet as the sheet is lifted away from the stack;

and is characterized by control means mounted in the housing so as to project into the path which is taken by the separator when the cassette is moved into the housing to the sheet-feeding position, the extent of such projection having one of at least two possible values, each corresponding to a different feed rate of the sheet feeder, whereby when the cassette is moved into the housing the control means automatically displaces the separator tip to cause it to project, to an extent depending upon the feed rate, into the path which will be followed by the said edge of a sheet lifted from the stack by the pick-up device.

The invention is based on our discovery that to reduce to a minimum the number of double feeds the amount by which the tip of the separator extends into the path of the fed sheet should vary with the rate of feeding of the sheets. At high rates of feeding of the sheets, the separators are required to extend further into the feed path.

Preferably, when the amount by which the separator extends into the feed path is changed, the angle presented by the separator to a fed sheet is also changed.

In one embodiment of the invention, an electromechanical system recognises the required rate of feed of the feed module and initiates a mechanism in the feed module to adjust the separator accordingly.

In order that the invention may be better understood, two embodiments of apparatus designed for feeding banknotes will now be described with reference to the accompanying drawings, in which:

BRIEF DESCRIPTION OF THE DRAWINGS

FIGS. 1 and 2 illustrate a first embodiment of a cassette and feed module embodying the invention, in two different relative positions; and FIGS. 3 and 4 illustrate a second embodiment of the cassette and feed module in the same relative positions, respectively, as in FIGS. 1 and 2.

DETAILED DESCRIPTION OF THE PREFERRED EMBODIMENT

In FIG. 1, a cassette 10 is being pushed in the direction of the arrow 12 into a feed module illustrated diagramatically at 14. The cassette 10 contains a stack 16 of sheets to be fed singly.

The feed module comprises a suction arm 18 and a pair of feed rollers 20 and 22. The suction arm 18 is given an oscillatory angular motion about its pivot. In the drawings, it is shown in one extreme position in which, as shown in FIG. 2, the portion 24 bears against the leading face of the stack of notes and a portion 26 of the arm, which contains a suction aperture or apertures, lies against the front note below the portion 24. When the arm pivots in a clockwise direction, it pulls the lower portion of the front note away from the remainder of the stack and introduces the end into the nip of the pair of feed rollers 20 and 22. The roller 22 is formed to provide a broken nip. The feed rollers, at least one of which is driven in rotation, then grip the leading end of the note and pull the note past the suction arm 18 and away from the stack.

It will be appreciated that there is a tendency for a second note to cling to the leading note when the lower edge of the leading note is pulled away from the stack by the suction arm 18. To reduce the possibility of this second note being fed through the rollers with the first one, it is known to provide on the base of the stack support, just ahead of the sheets, a lip or spring which is contacted by the lower edge of the note as it is swung away from the stack by the suction arm 18. If a second note clings to the first, the separator lip or spring, in "flicking" the edge of the notes, will usually give them the minute separation which is all that is required to cause the second note to fall back against the stack. An example of this arrangement is more fully described in our British Patent Specification No. 1296770.

However, although the separator lip greatly reduces the number of double feeds, it does not altogether prevent them. We have found that, as might be expected, the number of double feeds varies with the feed rate but we have also found that the extent of variation in the number of double feeds at different rates can be reduced by varying the height of the lip or separator spring in accordance with the feed rate. In other words, we have found that the height of the lip required for an optimum result varies with the feed rate of the module.

For this reason, in a module embodying the present invention the height of the tip of the separator spring is adjustable. In this embodiment, the angle which the spring makes with the base of the support for the stack of notes is also variable.

Referring again to FIG. 1, the body portion 29 of a separator 28 is hinged at 30 to a plate 32 fixed to a support 34 for the stack 16 of notes. In the normal position of the separator, its terminal spring 36 projects into the path of the notes to the extent shown in FIG. 1. This is suitable, in the example which is being described, for a feed speed of 4 notes per second.

If it is desired to feed the notes at 8 notes/second, a snap-on addition 38 is fixed to the feed module. This includes a horizontally extending plate 40 which, when the cassette is inserted into the feed module, rides under the separator 28 and pushes the body portion 29 and spring 36 of the separator into the position shown in FIG. 2. In this position, it will be seen that the separator is raised and extends further into the feed path and furthermore that the angle made by the separator with the forward extension of the support 34 is also increased.

Thus, when the cassette is to be used with a module which is designed to or is adjusted to feed notes at 8 notes/second, the snap-on addition 38 is put into place. If the feed module is to be used at 4 notes/second, the snap-on addition is not used.

Cassettes having a fixed lip or separator spring rising above the support for the stack of sheets present a problem to the operator when a stack of sheets is loaded into the cassette. The reason for this is that the stack of sheets has to be lifted over the separator. To overcome this problem, in the embodiment of the invention shown in FIGS. 3 and 4, the separator is so arranged that in its "rest" position it lies entirely below the support for the stack of sheets (see FIG. 3). If the cassette is to be used with a feed module feeding notes at 4 notes/second, a snap-on addition 38*a* having a lower extension 40*a* is used, to raise the separator into the position shown in FIG. 4 when the cassette is loaded into the feed module. If the cassette is to be used with a feed module operating at 8 notes/second, the snap-on addition 38*a* is replaced by one having a plate 40 of the kind shown in FIG. 1.

The multiple-speed sheet feeder may include means responsive to a selected rate of feed to adjust the extent of projection of the control means into the path taken by the separator when the cassette is moved into the housing.

We claim:

1. Sheet feeding apparatus comprising:

a housing;

a cassette for a stack of sheets, movable into and out of the housing to and from a sheet feeding position;

a sheet feeder mounted in the housing and including means for lifting sheets one by one from the stack in the cassette and to advance each sheet in turn away from the stack;

the cassette including an adjustable separator the tip of which, when the cassette is in the sheet-feeding position, extends into the path of an edge of a sheet as the sheet is lifted away from the stack;

and control means comprising a plurality of interchangeable elements each mounted one at a time in the housing so as to project into the path which is taken by the separator when the cassette is moved into the housing to the sheet-feeding position, each element having a different projection position corresponding to one of at least two possible levels, each corresponding to a different feed rate of the sheet feeder, whereby when the cassette is moved into the housing the control means automatically displaces the separator tip to cause it to project, to a further or lesser extent depending upon the feed rate, into the path which will be followed by the said edge of a sheet lifted from the stack by said lifting means.

2. Sheet feeding apparatus in accordance with claim 1, in which in the cassette is a support for the sheets which extends forward of the position of the stack and includes an aperture and the separator is mounted so that a lower portion of the separator lies under the support and the tip projects through the aperture, and in which the control means is mounted in a position to engage the lower portion of the separator when the cassette is loaded into the feeder and thereby to urge the tip of the separator into the path of the leading edge of the front sheet by an amount dependent upon the feed rate of the sheet feeder.

3. Sheet feeding apparatus in accordance with claim 2, in which the separator, when not engaged by the control means, lies entirely under the support for the stack of sheets in the cassette to facilitate loading of a stack of sheets into the cassette.

4. Sheet feeding apparatus in accordance with claim 1, in which the separator and control means are so constructed that the angle made by the tip of the separator with the surface of the support is varied at the same time as the amount of extension of the tip into the path of the sheet is varied by the control means.

* * * * *